United States Patent [19]

Asami et al.

[11] Patent Number: 5,020,784

[45] Date of Patent: Jun. 4, 1991

[54] METHOD AND APPARATUS FOR ARRANGING PAPERS

[75] Inventors: Shinji Asami; Tadashi Ikoma, both of Yokohama, Japan

[73] Assignee: Ricoh Company, Ltd., Tokyo, Japan

[21] Appl. No.: 408,528

[22] Filed: Sep. 18, 1989

[30] Foreign Application Priority Data

Sep. 27, 1988 [JP] Japan ..... 63-239688
Oct. 14, 1988 [JP] Japan ..... 63-257339

[51] Int. Cl.[5] ..... B42B 2/00
[52] U.S. Cl. ..... 270/53; 270/58
[58] Field of Search ..... 270/53, 37, 58

[56] References Cited

U.S. PATENT DOCUMENTS 4,248,413 2/1981 Fox ..... 270/53
4,424,963 1/1984 Bartholet ..... 270/53
4,491,929 1/1985 Ikoma .

FOREIGN PATENT DOCUMENTS 3705895 9/1987 Fed. Rep. of Germany .
59-82263 5/1984 Japan .
63-109448 5/1988 Japan ..... 270/53

*Primary Examiner*—John T. Kwon
*Assistant Examiner*—Therese M. Newholm
*Attorney, Agent, or Firm*—Oblon, Spivak, McClelland, Maier & Neustadt

[57] ABSTRACT

An apparatus for arranging papers comprising a route switch lever which changes paper conveyor route for conveying a paper after a treatment depending on whether the paper is to be directly transferred to a discharge tray or stacked to form a paper group to be stapled together. The apparatus also comprises a stapler which receives papers one by one to form a stack of papers and staples an end of the paper stack. The apparatus further comprises a junction unit which has a conveyor route for directly transferring the paper to the discharge tray and is capable of moving between a first position for receiving a stapled group of papers from the stapling means and a second position for transferring the stapled group of papers to the discharge tray.

8 Claims, 9 Drawing Sheets

METHOD AND APPARATUS FOR ARRANGING PAPERS

BACKGROUND OF THE INVENTION

The present invention relates to a method and apparatus for arranging papers especially for aligning edges of papers stacked on a stacker tray so as to staple them for the purpose of various kind of editing operations.

Image forming apparatus such as copying apparatus which is equiped with a paper edge aligning apparatus is known. Such an apparatus for aligning paper edges is used, for example, for the purpose of stapling a group of the papers of copy.

An example of the known apparatus for aligning the copy paper edges is disclosed in Japanese Unexamined Patent Publication No. 59-78069.

The conventional apparatus comprises a copying apparatus body in which a photoconductor drum and a developing device are disposed. On the photoconductor drum, a visible toner image developed by the developing device is formed. The toner image is transferred to a transfer paper fed from a paper supply portion. After that, the paper on which the toner image is transferred passes through a fixing device and is then discharged through a pair of outlet rollers.

The discharged paper falls due to the gravity onto a support table on which the paper is moved by conveyor rollers toward a stop. In this conveying motion, the paper is biassed to one side of the conveyor route by a paddle wheel which is obliquely disposed with respect to the paper conveying direction.

A leading edge of the paper abuts against the stop so that the paper edge is aligned with the stop. When a predetermined number of papers are stacked on the table, the paper stack is stapled by a stapler. After that, the stop is moved away from the paper stack so that a group of the stapled papers is discharged onto a tray disposed below the support table.

In accordance with the conventional apparatus for aligning the paper edges mentioned above, the apparatus is arranged in such a way that the paper discharged through the outlet rollers falls naturally by the gravity which takes a relatively long time to reach the support table and impedes high speed prosecution of editing operation.

On the other hand, an example of apparatus for arranging papers equipped with means for stapling a bundle of copies is disclosed in Japanese Unexamined Patent Publication No. 59-82263. The apparatus disclosed in the publication comprises a first conveyor route for conveying a copy paper which is to be discharged without stapling operation and a second conveyor route for conveying a copy paper which is to be stacked and stapled. The paper to be stapled is conveyed in such a way that the paper is turned over after the paper is stapled so that the trailing edge thereof becomes the leading edge thereof and discharged out of the apparatus.

However, in accordance with the prior art structure mentioned above, the group of the stapled copies is conveyed along and around the conveyor rollers which have a relatively small diameter, which causes malfunction of paper conveyor especially when the paper is thick or a large number of papers are stapled together since the paper or the stapled paper group is hard and not easy to be bent according to the roller arrangement. Therefore, the number of papers to be stapled is limited to about twenty five in accordance with the conventional structure mentioned above.

SUMMARY OF THE INVENTION

The present invention was made considering the points mentioned above. It is therefore a primary object of the present invention to provide a method and apparatus for arranging papers in which papers which are to be discharged without stapling operation are reliably and quickly conveyed to the paper discharge tray and in which the stapled papers can be reliably and smoothly conveyed and discharged even if more than twenty five papers are stacked and stapled together.

Another object of the present invention is to provide an apparatus for aligning paper edges in which the problems of the prior art structure are obviated so that the paper edges are smoothly and quickly aligned which makes it possible to shorten the time for editing operation.

The first object mentioned above can be achieved by an apparatus for arranging papers comprising: a first conveyor route for directly conveying papers to a paper tray; a second conveyor route for conveying papers to be stacked and stapled; a switch means for changing the conveyor route in response to the paper to be conveyed; means for stapling an edge of a paper bundle comprising a predetermined papers stacked in sequence; and a junction conveyor means which is movable between a first position for receiving the stapled paper bundle from the stapling means and a second position for transfering the stapled paper bundle to the paper tray.

In accordance with the structure of the present invention mentined above, the paper which is to be conveyed without stapling treatment is directly guided to the paper tray from the conveyor route changing means through the junction means one by one.

On the other hand, papers to be stapled are guided continuously onto a stapling tray where a predetermined number of papers are stacked thereon in a manner that the edges of papers are aligned so that an edge of the paper stack is stapled in sequence. After that, the other edge of the stapled paper bundle is guided into between a pair of junction rollers of the junction means which is in the first position so that the paper bundle is drawn into the rollers. After that, the junction means is shifted to the second position in a state that the stapled paper bundle being held between the pair of rollers. Then, the rollers are driven to rotate reversely so that the paper bundle is discharged from the junction rollers onto the paper tray.

The second object of the present invention mentioned before can be achieved by an appratus for aligning paper edges comprising: a paper support table disposed below a paper discharge outlet; an edge aligning means for aligning trailing edges of the papers discharged from the outlet and stacked on the paper support table for editing; and a paper end conveyor belt which is arranged substantially vertical with respect to the paper support table and the lower end thereof is positioned near the edge aligning means and which has teeth on the outer surface thereof for engaging with the trailing end of the paper discharged from the outlet so as to compulsively transfer the paper trailing end onto the support table.

Also, in accordance with the present invention, it is desirable to provide a means for receiving the leading edge of the paper discharged from the paper outlet, and to arrange the paper end conveyor belt in such a manner that the length between the means and the lower end of the paper end conveyor belt is shorter than the length between the means and the upper end of the paper end conveyor belt.

An advantage of the present invention is that, with regard to the paper which is to be discharged one by one without stapling treatment, it becomes possible to reliably and quickly discharge the paper since the paper is guided directly to the paper tray from the conveyor route changing means through the transfer route of the paper junction conveyor means.

Also, another advantage of the present invention is that, with regard to the papers to be stacked and stapled, it becomes possible to reliably and smoothly discharge the stapled bundle of papers even if thick and hard papers are used or more than twenty five papers are stapled together, which is not possible in accordance with the prior art structure wherein the stapled bundle of papers has to be conveyed along and around the rollers having a relatively small diameter, whereas in accordance with the present invention, the apparatus is operated in such a way that, first the paper edges are aligned on the stapling tray, then the papers are stapled, that the stapled paper group is drawn into and held between the pair of junction transfer rollers of the junction means which is in the first position, and that the junction means is shifted to the second position so as to discharge the stapled paper bundle onto the paper tray by reversing the junction transfer rollers.

Still another advantage of the present invention is that the time for aligning edges of papers discharged from the paper outlet is remarkably shortened, which makes it possible to heighten the editing speed.

Also, in accordance with the preferable structure of the present invention mentioned before, it becomes possible to further shorten the time for aligning the edges of the papers discharged from the paper outlet.

Further objects and advantages of the present invention will be apparent from the following description of the preferred embodiments of the invention as illustrated in the accompanying drawings.

DESCRIPTION OF THE PREFERRED EMBODIMENTS

The present invention is further described hereinafter in detail by way of examples with reference to the drawings.

Figure 1:
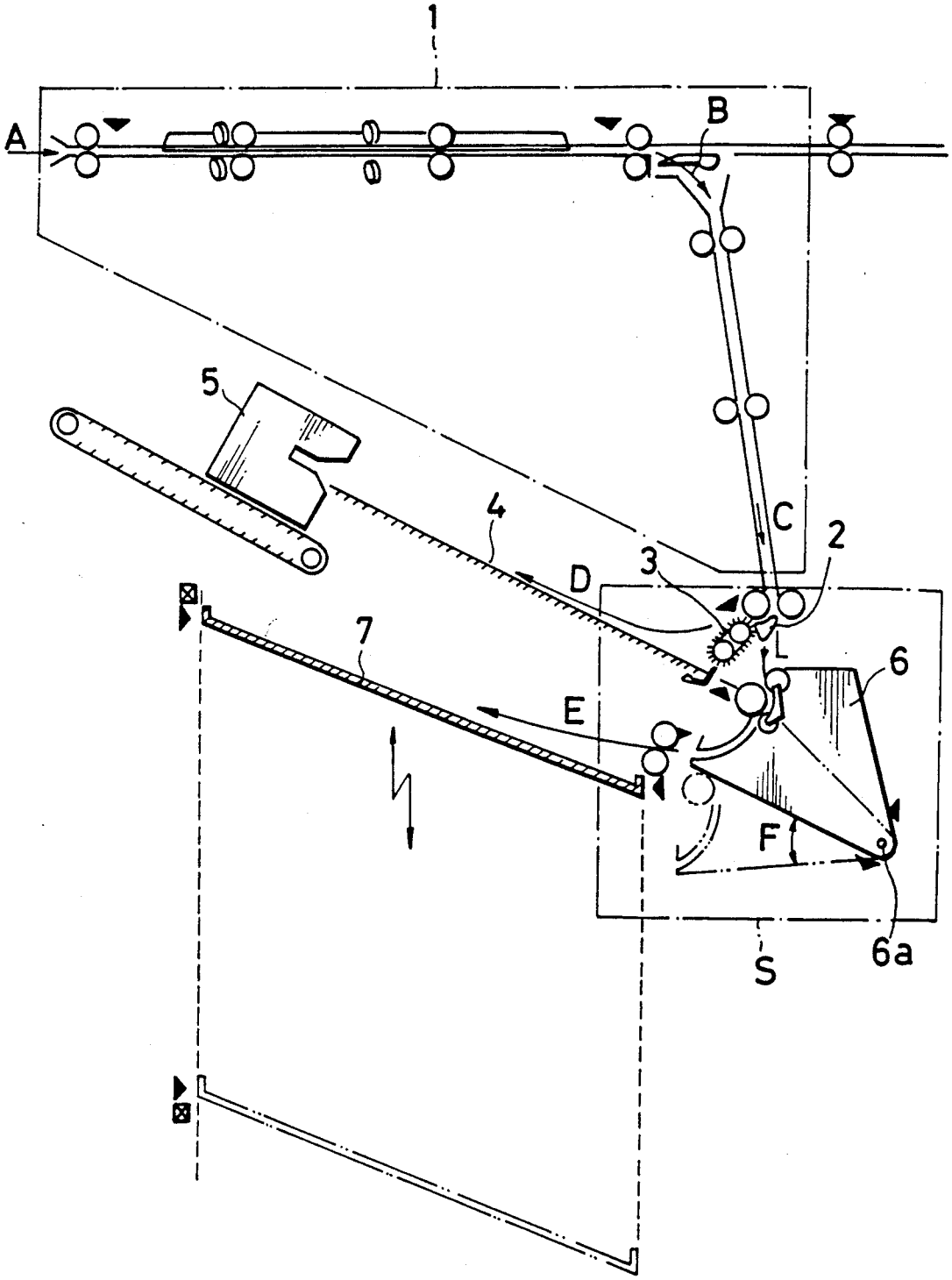
FIG. 1 is a constructional view of an embodiment of the present invention.

FIG. 1 illustrates a whole structure of an apparatus for aligning copy paper edges in accordance with an embodiment of the present invention. Numeral 1 designates a copy conveyance portion to which a copy paper is transferred from copying apparatus as an arrow A. Copy papers are conveyed as an arrows B and C along a conveyor route in the copy conveyance portion 1. Numeral 2 designates a route switch which changes the conveyor route depending on whether the copy paper is to be directly transferred to a paper tray 7 or stacked and stapled as a group of copy papers. Numeral 3 designates a transfer means for transferring copies to be stapled onto a stapling tray 4 in sequence, as shown by an arrow D. Numeral 5 designates a stapler for stapling a bundle of copy papers. The stapler 5 is adjustable according to the size of the paper. Numeral 6 designates a junction unit which comprises a conveyor route for directly transferring the copy paper from the route switch 2 to the paper tray 7 and is rotatable about a pivot 6*a* within a predetermined range of angle F so that the unit 6 is movable between a first position (solid line) for receiving a stapled group of copy papers from the stapling tray 4 and a second position (dash-two-dot line) for transferring the stapled group of copy papers to the paper tray 7 as shown by an arrow E.

Note that mark ▲ in the drawing designates a sensor for detecting a paper or another movable member.

Figure 2:
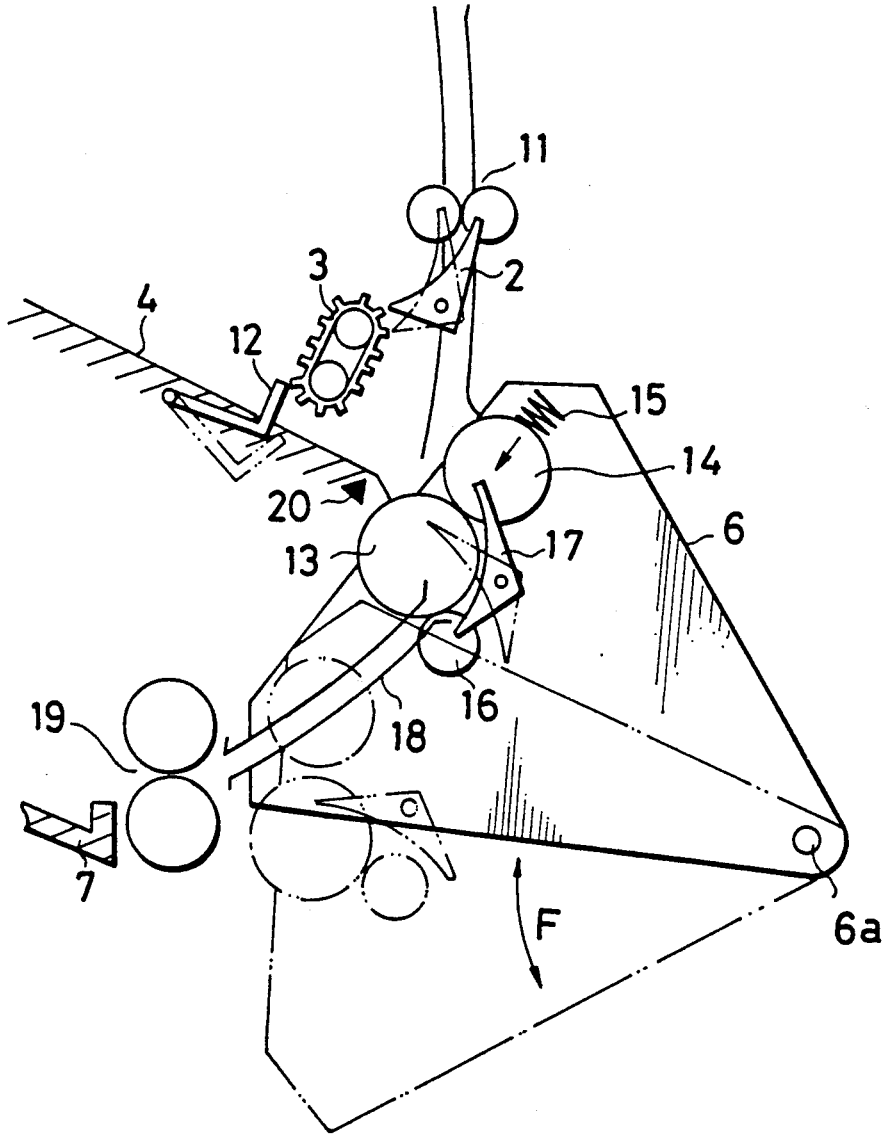
FIG. 2 is an enlarged partial view of a main portion of the structure of FIG. 1.

FIG. 2 illustrates a main portion of the present invention in detail which portion is designated by reference S and enclosed by a dash-dot line in FIG. 1. The structure of this portion comprises a pair of conveyor rollers 11, the route switch 2 mentioned above, a stop 12 against which lower ends of papers stacked on the stapling tray 4 abuts and which is withdrawn below the tray surface as depicted by a dash-two-dot line to draw out the stapled group of copy papers, a pair of junction rollers 13 and 14, a spring 15 for urging the roller 14 against the roller 13, a follower roller 16 urged against the roller 13, a change lever 17, a pair of guide plates 18, a pair of discharge rollers 19 and a sensor 20. The junction unit 6 is rotatable about the pivot 6*a* as mentioned before.

The embodiment of the invention mentioned above functions as follows.

First, operation for copy paper which is not to be stapled is explained with reference to FIG. 3. In this case, the paper is directly transferred from the route switch 2 to the discharged paper tray 7 through the junction unit 6.

Figure 3:
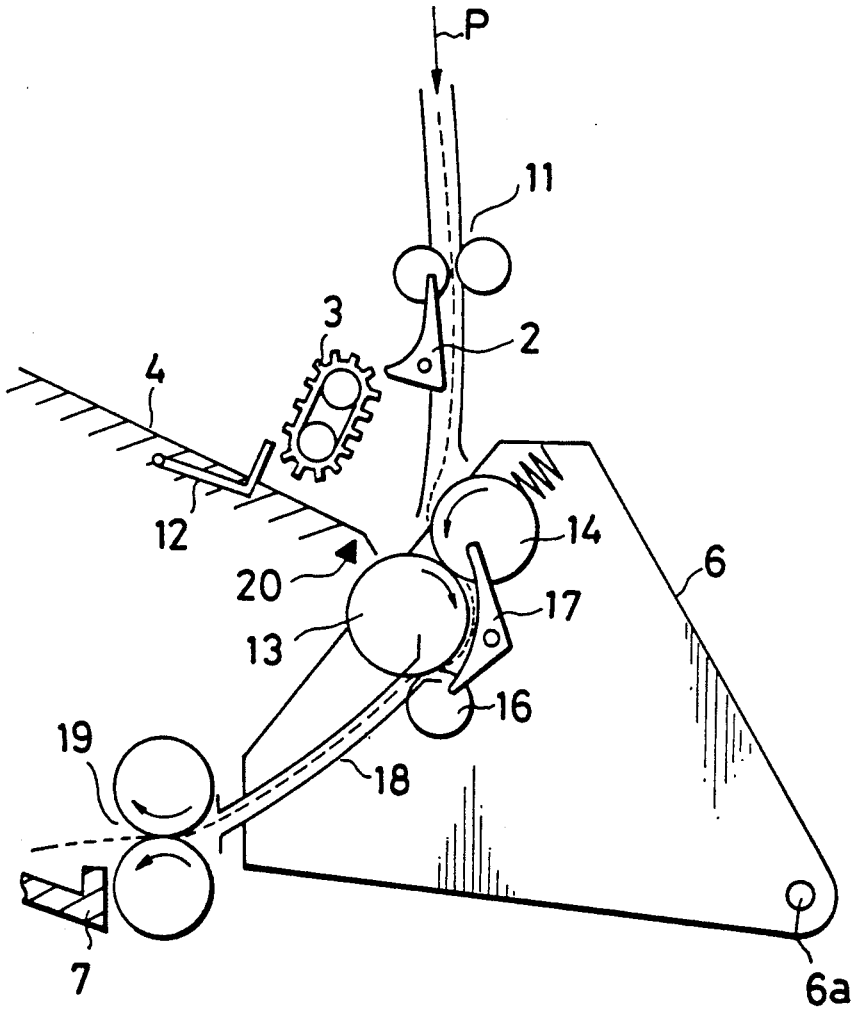
FIG. 3 is an explanatory view for explaining the function of the structure of FIG. 2 in a state of operation for paper to be discharged without being stapled.

The junction unit 6 is usually in the first position of FIG. 3 in which the route switch 2 opens the conveyor route as illustrated in the drawing so that a copy P is introduced into the pair of junction rollers 13 and 14.

The change lever 17 is arranged as illustrated in the drawing so that the copy proceeds along the guide plate 18 and is discharged onto the paper tray 7 through the discharge rollers 19.

Figure 4:
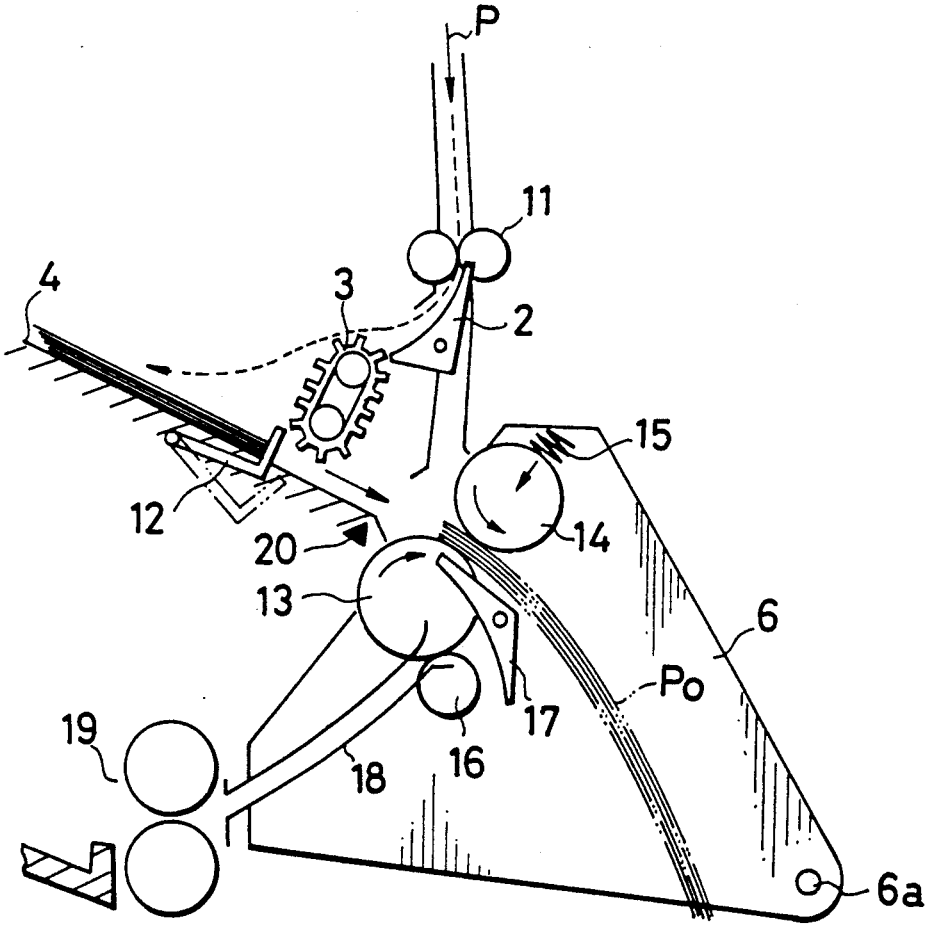
FIG. 4 is an explanatory view for explaining the function of the structure of FIG. 2 in a state of operation for paper to be stacked and stapled.

On the other hand, operation for copy paper which is to be stapled is carried out as illustrated in FIG. 4. In this operation, the route switch 2 is changed as illustrated in the drawing so that the copy P is transferred from the conveyor rollers 11 through the transfer means 3 onto the stapling tray 4. The lower edge of the copy transferred onto the stapling tray 4 is supported by the stop 12 and aligned therewith. When a predetermined number of papers are stacked, an end of the paper stack is stapled by the stapler 5 (FIG. 1). After that, the stop 12 is withdrawn from the tray surface so that the stapled group of the papers Po moves downward and enters between the pair of the junction rollers 13 and 14 which rotate and take the stapled papers into the junction unit 6. When the stapled paper group Po moves a predetermined distance after the sensor 20 detects the rear end of the paper group Po, rotation of the rollers 13 and 14 stops so that the rollers 13 and 14 hold the rear portion of the paper group Po therebetween. It is to be noted that the roller 14 is biassed in the direction of the arrow by the spring 15 against the roller 13 so that the paper group Po is properly held between the rollers 13 and 14 irrespective of the thickness of the paper group. Also, in this state, the change lever 17 is evacuated so as not to interfere with the entrance of the papers.

Figure 5:
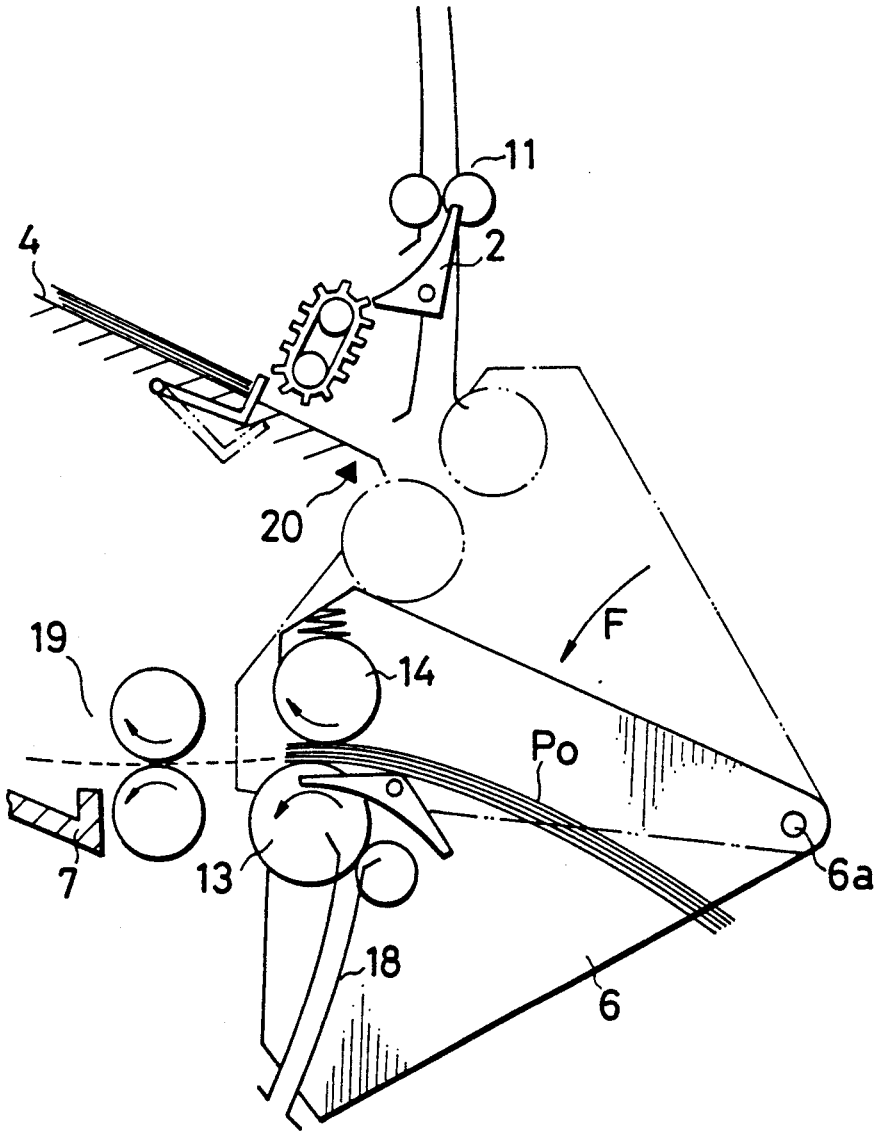
FIG. 5 is another explanatory view for explaining the function of the structure of FIG. 2 in a state of operation for paper to be stacked and stapled.

The junction unit 6 which holds the group of papers Po therewithin then rotates about the pivot 6*a* by a predetermined angle as shown by an arrow F in FIG. 5 and moves to the second position. After that, the rollers 13 and 14 are rotated in the reverse direction so that the group of papers Po is drawn out of the junction unit 6 and discharged through the discharge rollers 19 onto the paper tray 7. It is to be noted that during this junction motion of the unit 6, another group of papers is stacked on the stapling tray 4.

In accordance with the embodiment mentioned above, the junction unit 6 is arranged in such a way that the unit is rotatable about the pivot 6*a* to move between the first and second positions. However, the junctions unit 6 may be arranged to move linearly between the first and second positions instead of rotational motion arrangement mentioned above.

The paper edge alignment mechanism used in the copying apparatus mentioned above or the like is further described hereinafter in detail in comparison with the prior art.

Figure 12:
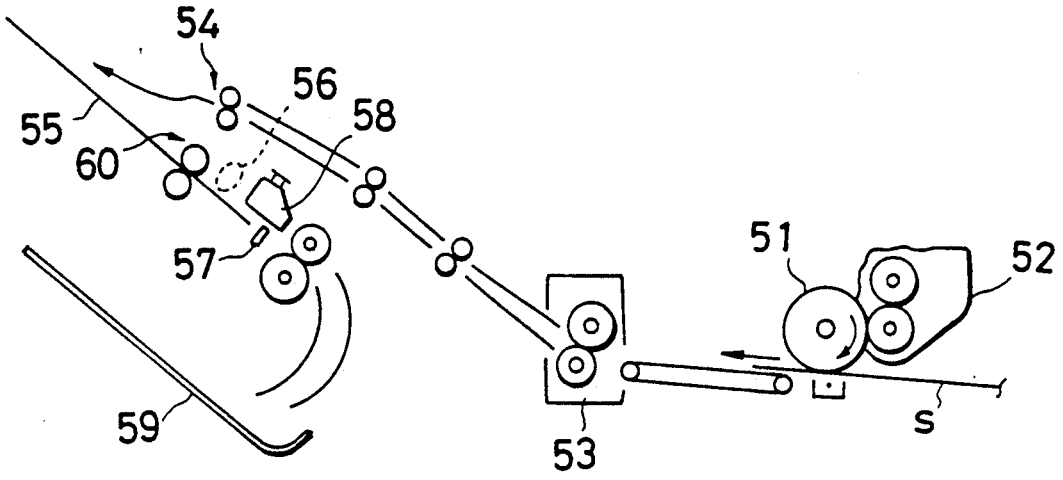
FIG. 12 is a constructional view of an apparatus for aligning paper edges in accordance with prior art.

FIG. 12 illustrates a conventional paper edge alignment apparatus for editing papers. Such an apparatus is dislosed in Japanese Unexamined patent publication No. 59-78069, as mentioned before.

The conventional apparatus comprises a copying apparatus body in which a photoconductor drum 51 and a developing device 52 are disposed. On the photoconductor drum 51, a visible toner image developed by the developing device 52 is formed. The toner image is transferred to a transfer paper S fed from a paper supply portion. After that, the paper on which the toner image is transferred passes through a fixing device 53 and is then discharged through a pair of outlet rollers 54.

The discharged paper falls due to the gravity onto a support table 55 on which the paper is moved by conveyor rollers 60 toward a stop 57. In this conveying motion, the paper is biassed to one side of the conveyor route by a paddle wheel 56 which is obliquely disposed with respect to the paper conveying direction.

A leading edge of the paper abuts against the stop 57 so that the paper edge is aligned with the stop. When a predetermined number of papers are stacked on the table 55, the paper stack is stapled by a stapler 58. After that, the stop 57 is moved away from the paper stack in the direction of an arrow as illustrated in FIG. 13 so that a group of the stapled papers is discharged onto a tray 59 disposed below the support table.

Figure 13:
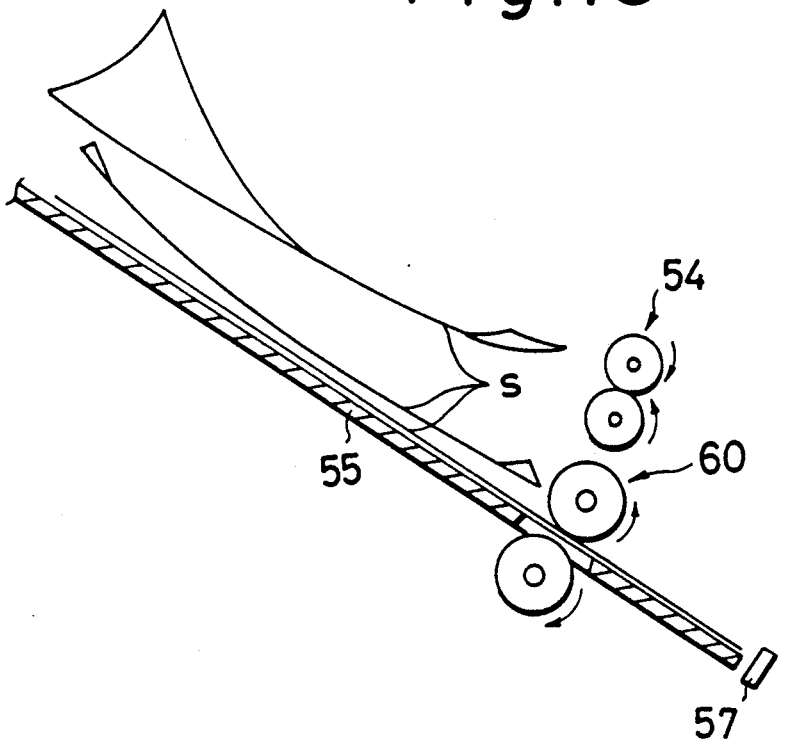
FIG. 13 is an explanatory view for explaining a state of a discharged paper which falls by natural gravity in accordance with the prior art.

In accordance with the conventional apparatus for aligning the paper edges mentioned above, the apparatus is arranged in such a way that the paper S discharged through the outlet rollers 54 falls naturally by the grabity as illustrated in FIG. 13, which takes a relatively long time for the paper to reach the support table 55 and impedes high speed prosecution of editing operation.

The problems of the prior art mentioned above can be obviated by an apparatus for aligning paper edges in accordance with the present invention described below.

Figure 6:
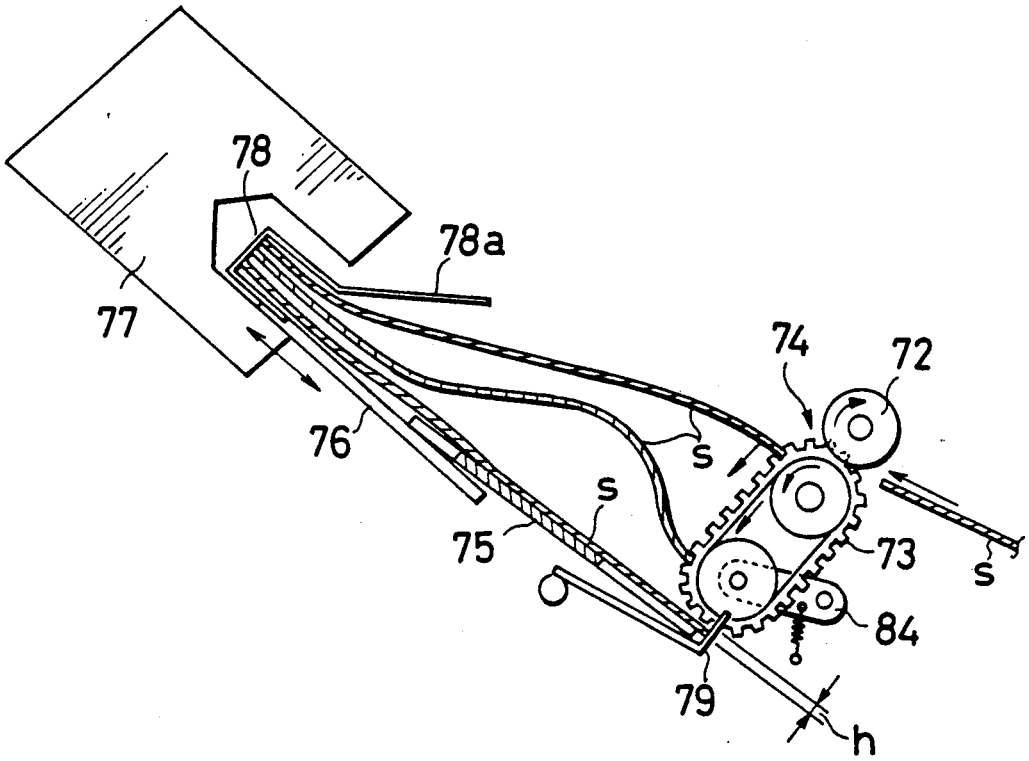
FIG. 6 is a constructional view of another embodiment of the present invention.

In FIG. 6, reference s designates a paper or sheet which is to be treated by the apparatus in accordance with the embodiment of the present invention. The paper may be a copy when the apparatus is assembled with a copying machine or a record paper when the apparatus is assembled with a printer or a facsimile.

The paper s is discharged through a paper discharge portion (outlet) 74 formed between a discharge roller 72 and an upper portion of a paper end conveyor belt 73 described later.

Numerals 75 and 76 designate a pair of support tables which receive papers discharged downward from the paper discharge portion 74 one by one. One of the support tables 76 is slidable as represented by a double-head arrow along with a stapler 77 described later.

On the side of the stapler 77 or on the side of the support table 76 as is the case in this particular embodiment, a paper end stop 78 is secured. A leading end of each paper fed from the discharge portion 74 abuts against the stop 78 and received on the support tables 75 and 76. The stop 78 has an upper plate 78*a* which is bent upward to widen the mouth thereof to reliably receive the leading end of the paper and guide it into the stop.

On a lower end portion of the support table 75, an edge aligning stop 79 is arranged. Rear ends of papers stacked on the tables 75 and 76 abut against the stop 79 and are aligned therewith.

The lower portion of the paper end conveyor belt 73 is disposed in the vicinity of the edge aligning stop 79. Also, the belt 73 is arranged vertical with respect to the support table 75. The paper end conveyor belt 73 comprises an endless belt having teeth on the outer surface thereof to form lateral grooves at a regular pitch.

Figure 7:
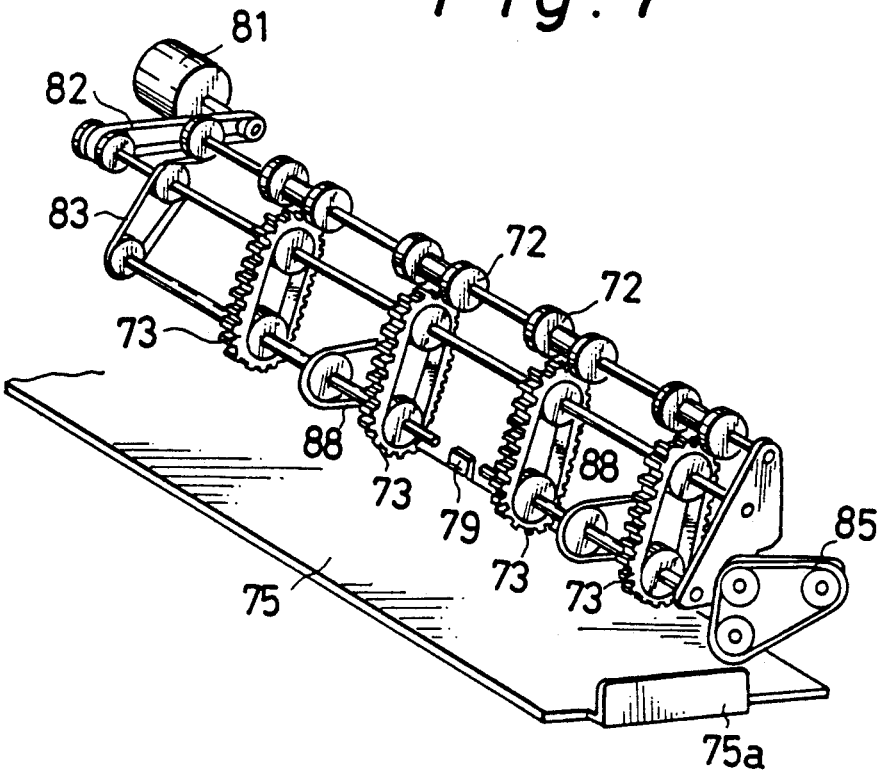
FIG. 7 is a perspective view of a paper end conveyor belt array arranged in the structure of FIG. 6.

As illustrated in FIG. 7, four sets of the paper end conveyor belt 73 are disposed on the support table 75, in this particular embodiment, along the lateral direction of the table (perpendicular to the paper conveying direction). Each belt 73 is driven by a drive motor 81 along with the discharge rollers 72 through a drive belt 82 and a transmission belt 83.

As illustrated in FIG. 6, the paper end conveyor belt 73 is driven to rotate in the direction of an arrow in a state of being biassed by a tension arm 84. The paper fed through the paper discharge portion 74 inertially flies and enters into the paper end stop 78 so that the leading end thereof abuts against the stop 78.

Figure 8:
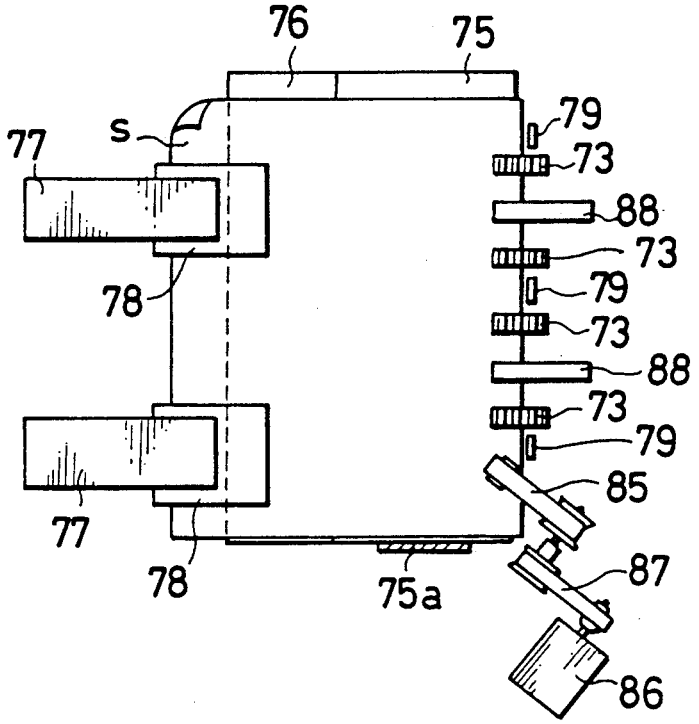
FIG. 8 is a plan view of the embodiment of FIG. 6 representing layout of staplers and the paper end conveyor belts.

On the other hand, the trailing end of the paper s is received in a groove of the paper end conveyor belt 73 and compulsively guided toward the support table 75. Around a lower end portion of the conveyor belt 73, the rear end of the paper is moved toward the edge aligning stop 79 in accordance with the motion of the belt 73 turning around the lower drive roller. Also, the paper is biassed obliquely toward a side guide 75*a* disposed along a side edge of the support table 75 by a bias belt 85 which is obliquely disposed on the table as illustrated in FIGS. 7 and 8. Therefore, the paper is moved in the oblique direction to abut against the stop 79 and the side guide 75*a*. Note that a plurality of edge aligning stops 79, for example eight in this particular embodiment as illustrated in FIG. 8, are disposed on the table 75, however only one is illustrated in FIG. 7.

As mentioned above, the papers discharged through the discharge portion 74 in sequence are placed at a predetermined position in a manner that the edges thereof are aligned with a predetermined line along the stops 79 and the side guide 75*a*. When a predetermined number of papers are stacked on the table, the paper stack is stapled by an electric stapler 77 illustrated in FIGS. 6 and 8 to form a group of papers to be edited.

It is to be noted that the above-mentioned bias belt 85 is driven by a drive motor 86 through a transmission belt 87 as illustrated in FIG. 8.

Figure 9:
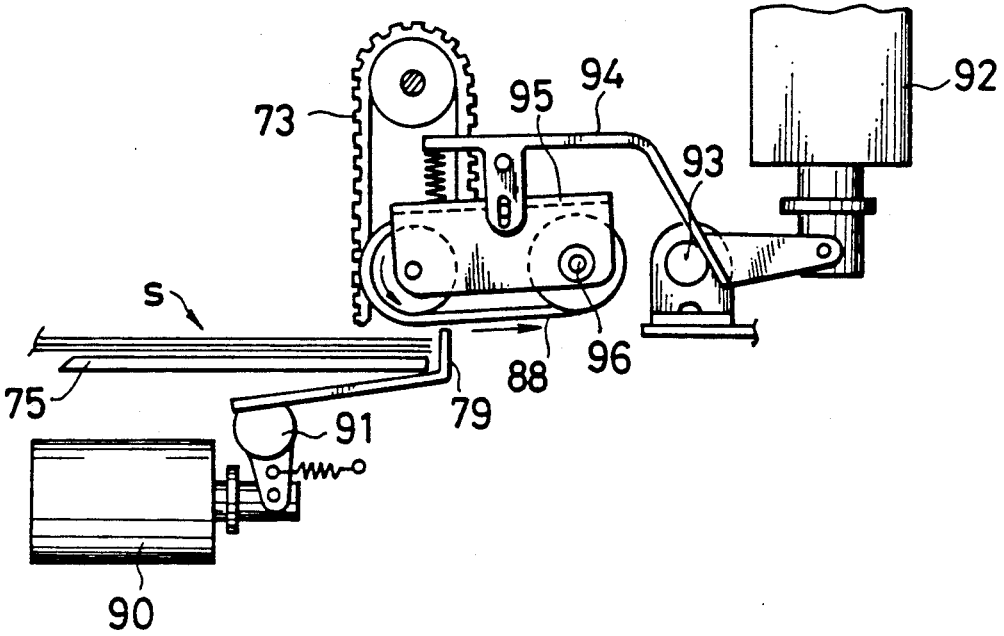
FIG. 9 is a side view of the embodiment of FIG. 6 representing the structure around the paper end conveyor belt and the discharge belt.

In the above-mentioned arrangement illustrated in FIGS. 7 to 9, a paper discharge belt 88 is disposed between the paper end conveyor belts 73. The paper discharge belt 88 is driven to rotate in the counterclockwise direction in FIG. 9. A roller for discharging papers may be arranged instead of the paper discharge belt 88.

Figure 10:
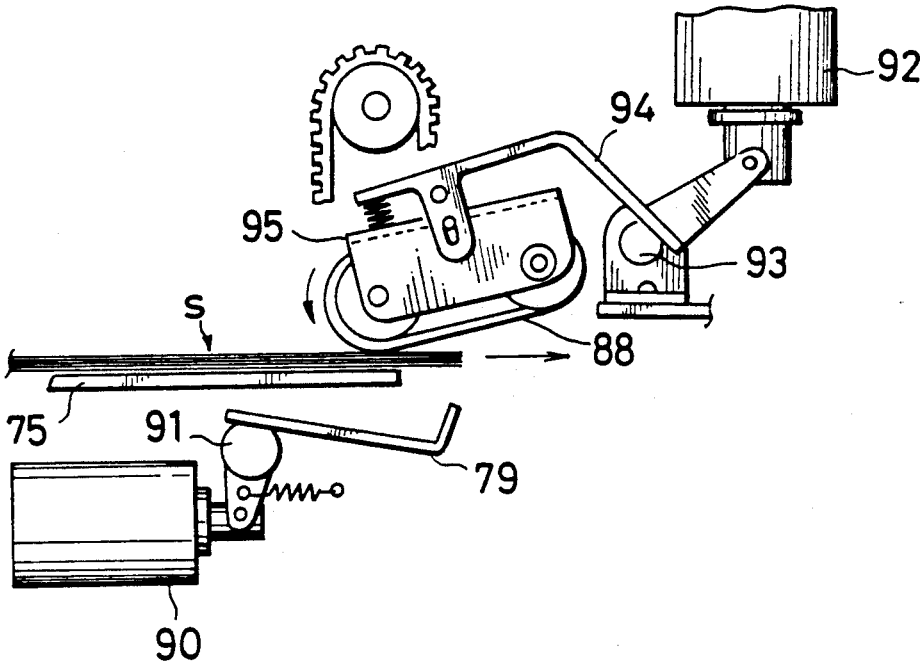
FIG. 10 is a side view similar to that of FIG. 9 representing a state where the paper discharge belt comes in contact with paper.

With reference to FIG. 9, when the paper stack is stapled by the stapler, a solenoid 90 is energized to withdraw the edge aligning stop 79 in such a manner that the plurality of stops 79 which are secured to a pivot shaft 91 at an end thereof are rotated to move to a position illustrated in FIG. 10 so that the conveyor route for the stapled group of papers is opened.

Along with the operation mentioned above, a solenoid 92 for shifting the paper discharge belt 88 illustrated in FIG. 9 is energized so that a bracket member 94 integral with a pivot shaft 93 is rotated whereby the paper discharge belt 88 is rotated in the counterclockwise direction about an axis 96 through a support frame 95 so that, as illustrated in FIG. 10, the left end side of the belt 88 comes in contact with the stapled group of papers.

The paper discharge belt 88 then discharges the stapled papers out of the table 75 to a discharge tray (not shown). Members 92 to 95 constitute an example of means for pressing papers.

In the structure mentioned above, the support table 75 is inclined by thirty five to forty five degrees with respect to a horizontal plane, thus the leading end of the paper discharged from the discharge portion 74 is oriented obliquely upward. The papers stacked on the support table smoothly slide downward since the table is inclined. However, it takes a long time for the paper to fall onto the table surface since the paper is discharged obliquely upward.

Conventionally, the paper is left free to fall by natural gravity. In this case, lifting force by air functions to the paper, which slows the falling motion of the paper. Especially, when the paper is curled upward, the paper motion is further slowed down so that sometimes the subsequent paper comes in contact with the preceding paper.

In accordance with the embodiment of the present invention, the rear end of the paper is caught by a tooth of the paper end conveyor belt 73 and urged to move quickly to the support table 75, which makes it possible to shorten the time for editing operation.

It is to be noted that the paper end stop 78 illustrated in FIG. 6 is not indispensable to the invention. In the case without provision of the paper end stop 78, the paper is discharged obliquely upward toward the stapler 77 and then moves backward naturally toward the paper end conveyor belt 73 so that the rear end of the paper is caught by one of the teeth of the belt 73 and urged to move to the support table 75, thus shortening the time to wait for starting the stapling operation in comparison to the case wherein the paper falls by natural gravity.

With the provision of the paper end stop 78, it becomes possible to shorten the time for backward motion of the paper to the paper end conveyor belt 73 as well as to urge the rear end of the paper into the edge aligning stop 79 due to stretching function of the paper.

Accordingly, it becomes possible to save the time that the paper slides backward by gravity on the support table 75 until abutting against the edge aligning stop 79.

Figure 11:
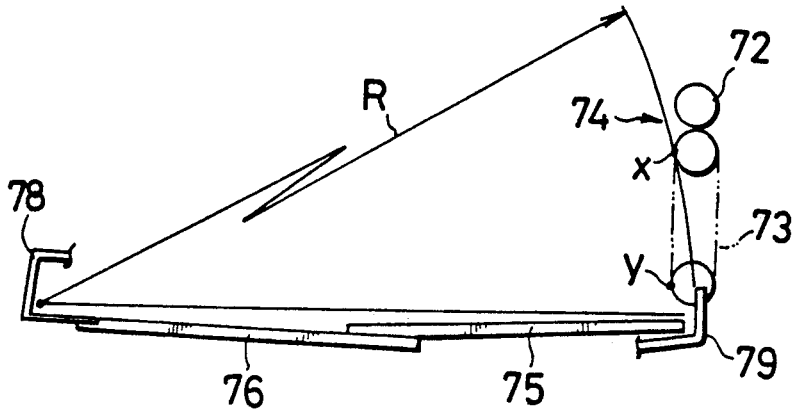
FIG. 11 is an explanatory view for explaining the arrangement of the paper end conveyor belt.

With reference to FIG. 11, paper is discharged from the discharge portion 74 and the leading end thereof abuts against the paper end stop 78. After that, the rear end of the paper is caught by the paper end conveyor belt 73 and compulsively guided to the support table 75. Trace of the turning motion of the rear end of the paper is represented by an circular arc of curvature R. The trace crosses over the paper end conveyor belt 73 as illustrated in the drawing.

In other words, the length between the stop 78 and an upper point x of the conveyor belt 73 is longer than the length between the stop 78 and a lower point y of the conveyor belt 73, as can be seen from FIG. 11. The former is approximately equal to the length of the paper. The paper end conveyor belt 73 is arranged in such a manner mentioned above.

By equalizing the length between the stop 78 and the upper point x to the length of the paper, the rear end of the paper is reliably caught by one of the teeth of the conveyor belt 73.

Also, by the arrangement wherein the length between the stop 78 and the lower point y is shorter than the length between the stop 78 and the upper point x, the paper is conveyed by the belt 73 to the support table 75 in a state of being curled as illustrated in FIG. 6, which prevents the rear end of the paper from being detached from the conveyor belt 73.

Note that, as illustrated in FIG. 6, gap h between the lower end of the conveyor belt 73 and the support table 75 is approximately equal to or slightly wider than the maximum thickness of the stack of papers to be stapled. When the paper end comes to the gap, the paper end enters into the gap to the edge aligning stop 79 due to the stretching force thereof.

With regard to the discharge belt 88, as illustrated in FIGS. 7 and 9, arrangement is made in such a manner that, in order not to impede the function of the paper end conveyor belt 73, the discharge belt 88 is disposed between the conveyor belts 73 and withdrawn from the groove bottom of the conveyor belt 73.

The above-mentioned discharge belt 88 may be used to move the paper toward the edge aligning stop 79 by driving the belt in a state of pressing contact with the paper on the support table 75.

The above-mentioned embodiments of the present invention are examples of the paper edge aligning apparatus in which a group of papers is stapled by a stapler. However, the present invention is applicable to any other apparatuses which treat papers to be properly arranged and edited.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for arranging papers comprising:

a switch means for changing a paper conveyor route for conveying a paper after a treatment depending on whether the paper is to be directly transferred to a discharge tray or to be stacked to form a paper group to be stapled together;

a stapling means for receiving papers one by one so as to form a paper stack and for stapling the paper stack at one end thereof; and a junction means including a pair of rollers being able to be positioned at each of a first position opposing to the stapling means and a second position opposing to the discharge tray, and a moving means for moving the rollers selectively to one of the first position and the second position, the rollers being adapted to receive the stapled paper stack at the first position and to discharge the stapled paper stack at the second position.

2. A method for arranging papers comprising:

a first step for receiving a predetermined number of papers after a treatment one by one to form a stack of papers and stapling an end of the paper stack;

a second step for guiding the other end of the stapled paper stack into between a pair of junction rollers which is in a first position by rotating the rollers and holding the end portion of the paper stack therebetween;

a third step for moving the junction rollers to a second position;

a fourth step for discharging the stapled papers to the discharge tray by reversely rotating the junction rollers.

3. An apparatus for arranging papers comprising:

a switch means for changing a paper conveyor route for conveying a paper after a treatment depending on whether the paper is to be directly transferred to a discharge tray or to be stacked to form a paper group to be stapled together;

a stapling means for receiving papers one by one so as to form a paper stack and for stapling the paper stack at one end thereof; and a junction means which has a conveyor route for directly transferring the paper to the discharge tray and which is capable of moving between a first position for receiving the stapled paper stack from the stapling means and a second position for transferring the stapled paper stack to the discharge tray, said junction means comprises a pair of rollers which are rotatable in one direction and vice versa, a change lever disposed behind the rollers for changing a paper conveyor route depending on whether one paper is to be conveyed or the stapled paper stack is to be conveyed, and a spring for urging one of the rollers against the other of the rollers.

4. An apparatus for arranging papers comprising:

a switch means for changing a paper conveyor route for conveying a paper after a treatment depending on whether the paper is to be directly transferred to a discharge tray or to be stacked to form a paper group to be stapled together;

a stapling means for receiving papers one by one so as to form a paper stack and for stapling a paper stack and for stapling the paper stack at one end thereof;

a junction means which has a conveyor route for directly transferring the paper to the discharge tray and which is capable of moving between a first position for receiving the stapled paper stack fromt he stapling means and a second position for transferring the stapled paper stack to the discharge tray, a support table for receiving one by one thereon papers discharged from a paper discharge outlet;

an aligning means for aligning rear ends of the papers received on the support table; and a conveyor belt arranged in such a manner that the lower end thereof is positioned in the vicinity of the aligning means and such that the belt is substantially vertical with respect to the support table, the conveyor belt having teeth on an outer surface thereof to thereby form a plurality of lateral grooves, the grooves catching a rear end of the paper and moving compulsively the rear end of the paper to the support table.

5. An apparatus for arranging papers according to claim 4, wherein said support table comprises a stop means for receiving a leading end of the paper, said stop means being disposed on an upper surface of the support table in such a manner that the length between the stop means and a lower portion of the paper end conveyor belt is shorter than the length between the stop means and an upper portion of the conveyor belt.

6. An apparatus for arranging papers according to claim 4, wherein said support table is inclined so as to orient downwardly the rear end of the paper.

7. An apparatus for arranging papers according to claim 4, wherein said aligning means comprises a stopper disposed on a rear end of the support table, the stopper being capable of being withdrawn from an upper surface of the support table.

8. An apparatus for arranging papers according to claim 4, wherein said support table comprises a pair of plates which are slidable with respect to each other in a conveying direction of the paper; and a stopper for the paper disposed on one of the table plates at a side of the plate corresponding to a leading end of the paper; whereby a distance between the stopper and the conveying belt is adjustable.

* * * * *